US006736059B2

(12) United States Patent
Katz et al.

(10) Patent No.: US 6,736,059 B2
(45) Date of Patent: May 18, 2004

(54) PROCESS FOR MAKING BAS-RELIEF SURFACES APPLIED TO DOWNY FABRICS

(76) Inventors: Tibério Katz, Av. Humberto Castelo Branco, 670-São Bernardo Do Campó, São Paulo (BR); Gabriel André Katz Hohn, Av. Humberto Castel Branco, 670-São Bernardo Do Campó, São Paulo (BR)

( * ) Notice: Subject to any disclaimer, the term of this patent is extended or adjusted under 35 U.S.C. 154(b) by 0 days.

(21) Appl. No.: 10/322,581

(22) Filed: Dec. 18, 2002

(65) Prior Publication Data

US 2003/0145744 A1 Aug. 7, 2003

(30) Foreign Application Priority Data

Feb. 5, 2002 (BR) ..... 0200619

(51) Int. Cl.[7] ..... B41M 1/12
(52) U.S. Cl. ..... 101/129; 101/488
(58) Field of Search ..... 101/114, 115, 101/116, 119, 120, 123, 129, 424.1, 425, 487, 488, 491

(56) References Cited

U.S. PATENT DOCUMENTS 2,359,825 A * 10/1944 Campbell ..... 101/115
3,779,161 A * 12/1973 Tatebe ..... 101/123
4,903,592 A * 2/1990 Ericsson ..... 101/115

* cited by examiner

*Primary Examiner*—Ren Yan
(74) *Attorney, Agent, or Firm*—Notaro & Michalos P.C.

(57) ABSTRACT

The present invention is directed to a process for making bas-relief surfaces applied to downy fabrics such as bedspreads, carpets and blankets, the proposed process being part of the proper logical sequence of the steps for making a downy fabric through the use of silk screen techniques and the equipment known as "tufting machine" and shredding machine, the proposed process being basically defined by the replacement of ink in at least one of the silk screen printing frames with a glue solution homogenized with a dye and the insertion of an intermediate step for drying the thus-printed fabric in the dryer after it leaves the vaporizer and before it is moved to the washer.

2 Claims, No Drawings

PROCESS FOR MAKING BAS-RELIEF SURFACES APPLIED TO DOWNY FABRICS

FIELD AND BACKGROUND OF THE INVENTION

The present invention is related to a process for making bas-relief surfaces applied to downy fabrics such as bedspreads, carpets and blankets.

Downy fabrics can be obtained from a large variety of manufacturing processes, as well as the creation of bas-relief surfaces applied to such fabrics. The present manufacturing process defines differentiated manufacturing steps in a process for making downy fabrics that employs equipment technically known as "tufting machine" or tuft-making machine, into which drawings or graphics are incorporated in printing step though silk screen techniques, which comprises basically the passage of ink through screens laid on the fabric and conveniently perforated in places where it is desired to apply ink to the fabric.

The creation of bas-relief areas in downy fabrics through conventional processes follows basically the following steps: heat seaming the areas through hot rollers; use of special scissors; change in the regulation of the tuft-making machine in order to create needle reading bands; flocking. Any of these solutions presents a number of inconveniences that range from the need of skilled workers for operating the equipment to the huge demand of time required for creating bas-relief areas, thus making the manufacturing process excessively expensive.

SUMMARY OF THE INVENTION

The object of the present invention is the formation of bas-relief surfaces that dispenses with the conventional means and methodologies for such formation and, consequently, avoids the problems described hereinabove, the proposed process being part of the logical sequence of the steps for making a downy fabric.

DETAILED DESCRIPTION OF THE PREFERRED EMBODIMENT

For a better understanding, a process for making downy fabrics will be generically described hereinbelow and then the details concerning the making of bas-relief in accordance with the present invention shall be specified afterwards.

As already described in the preamble, the process for making downy fabrics into which the process proposed for making bas-relief surfaces is incorporated is the one that uses a tuft-making machine or "tufting machine" and wherein the fabric is printed through silk screen techniques.

Basically, the manufacture of downy fabrics having such characteristics starts with the spinning step wherein tufts are adequately processed so that yarns suitable for the production of tufts can be obtained, said yarns being disposed in tapered bobbins.

The tapered bobbins are then placed close to the "tufting machine" where a plurality of loops is made on a base fabric by needling the yarns on the above mentioned tapered bobbins.

The downy fabric is then transferred to the printing unit where drawings or graphics are inserted into the surface of the fabric through silk screen techniques. As is known by those skilled in the art of printing, the silk screen technique employs a conveniently perforated screen for each color of ink applied to the fabric.

After the ink is applied, the fabric is sequentially moved to a vaporizer, a washer and a dryer, these steps being basically designed for fixating the printed colors and preparing the fabric for the next steps.

After leaving the dryer, the fabric is moved to the equipment called tentering machine, wherein it is adjusted on its cutting line and the drying process proceeds.

From the tentering machine, the fabric is moved to the equipment called shredding machine that pulls the fabric down through the rotation and translation of multiple rotating cylindrical brushes, providing same with a much higher thickness than the one it had when the loops were present.

From the shredding machine, the fabric is moved to a tuft-making machine, designed to disentangle the down.

After leaving the shredding machine, the fabric is moved to cutters that cut the down in a regular shape and provide same with bright.

Finally, the fabric is moved to the finishing and packing unit.

The process proposed for making bas-relief surfaces introduces changes in the printing step by replacing the ink in at least one of silk screen printing frames with a glue solution homogenized with a dye and adds an intermediate step for drying the thus-printed fabric in the dryer after leaving the vaporizer and before being moved to the washer. The remaining manufacturing steps are identical to those of the conventional process.

By replacing the usual silk screen ink with a glue mixture homogenized with a dye, the areas covered by said mixture are not affected by the shredding machine, so the down in such areas is not pulled, remaining close to the base fabric and directly creating the desired bas-relief areas opposed to the too thick areas through the intervention of the shredding machine in the portions of the down where the glue mixture homogenized with a dye has not been applied, without the interference of additional means, devices, equipment and skilled workers.

The drying step added between the usual vaporization and washing steps is designed for fixating the glue and uses the equipment already available in the conventional production line.

What is claimed is:

1. A process for making bas-relief surface applied to downy fabrics, the downy fabrics being prepared with a tufting machine, and printing is applied to the downy fabric by silk screen techniques, the process comprising:

spinning tufts to produce yarns, the yarns being disposed on bobbins;

producing a plurality of loops on a base fabric by needling the yarns from the bobbins using the tufting machine, thereby making the downy fabric;

transferring the downy fabric to a silk screen printing unit having silk screen printing frames each carrying a perforated screen for applying inks in a pattern defined by perforations of the perforated screens;

replacing the ink in at least one of the silk screen printing frames with a glue solution homogenized with a dye;

printing a drawing or graphic on the downy fabric by applying at least the glue solution homogenized with dye through the silk screen printing frames to form flattened areas of the downy fabric where the loops are glued against the base fabric;

transferring the printed fabric to a vaporizer;

drying the printed fabric in a dryer following leaving the vaporizer;

washing the printed fabric in a washer after drying;

drying the printed fabric a second time in a dryer and on a tentering machine following washing the printed fabric;

adjusting the printed fabric on a cutting line while on the tentering machine;

passing the printed fabric through a shredding machine having multiple rotating cylindrical brushes to increase a thickness of the printed fabric around the flattened areas, the loops in the flattened areas remaining glued to the base fabric, whereby a bas-relief pattern is formed by the flattened areas and thickened printed fabric;

disentangling down of the printed fabric;

cutting the printed fabric to shape; and providing the printed fabric with bright.

2. A process for making bas-relief surface applied to downy fabrics, the downy fabrics being prepared with a tufting machine, and printing is applied to the downy fabric by silk screen techniques, the downy fabrics being prepared by spinning tufts to produce yarns, the yarns being disposed on bobbins, then producing a plurality of loops on a base fabric by needling the yarns from the bobbins using the tufting machine, thereby making the downy fabric, the downy fabric being transferred to a silk screen printing unit having silk screen printing frames each carrying a perforated screen for applying inks in a pattern defined by perforations of the perforated screens and printing a drawing or graphic on the downy fabric, and then treating the printed fabric with a vaporizer, a dryer, a tentering machine and a washer before increasing a thickness of the printed fabric to greater than that formed by the plurality of loops by passing the printed fabric through a shredding machine having multiple rotating cylindrical brushes, disentangling down of the printed fabric, cutting the printed fabric to shape, and providing the printed fabric with bright, wherein the process comprises:

providing a glue solution homogenized with a dye in place of ink in at least one of the silk screen printing frames;

applying at least the glue solution homogenized with dye to the downy fabric through the silk screen printing frames when the drawing or graphic is printed to create flattened areas where the loops are glued to the base fabric;

treating the printed fabric comprises: drying the printed fabric in the dryer following leaving the vaporizer, washing the punted fabric in the washer after drying; and drying the printed fabric a second time in the dryer and an the tentering machine following washing the printed fabric; and when the printed fabric passes through the shredding machine, the loops in the flattened areas remain glued to the base fabric, whereby a bas-relief pattern is created by differences between the flattened areas and thickened printed fabric.

* * * * *